US009671076B2

(12) United States Patent
Chen et al.

(10) Patent No.: US 9,671,076 B2
(45) Date of Patent: Jun. 6, 2017

(54) RECESSED WALL WASH LIGHT FIXTURE WITH GLARE CONTROL

(71) Applicant: ABL IP HOLDING LLC, Conyers, GA (US)

(72) Inventors: Jie Chen, Snellville, GA (US); Jeffrey Paige Hughes, Sugar Hill, GA (US); Craig Eugene Marquardt, Covington, GA (US); Joseph J. Onda, Lawrenceville, GA (US); Mike Ken Juda, Milpitas, CA (US)

(73) Assignee: ABL IP Holding LLC, Decatur, GA (US)

( * ) Notice: Subject to any disclaimer, the term of this patent is extended or adjusted under 35 U.S.C. 154(b) by 23 days.

(21) Appl. No.: 14/702,157

(22) Filed: May 1, 2015

(65) Prior Publication Data

US 2016/0320008 A1 Nov. 3, 2016

(51) Int. Cl.

| | |
|---|---|
| ***F21V 15/00*** | (2015.01) |
| ***F21S 8/02*** | (2006.01) |
| ***F21V 7/04*** | (2006.01) |
| ***F21V 7/22*** | (2006.01) |
| ***F21V 13/02*** | (2006.01) |
| *F21V 3/00* | (2015.01) |
| *F21V 21/04* | (2006.01) |
| *F21Y 115/10* | (2016.01) |

(52) U.S. Cl.
CPC ..... *F21S 8/026* (2013.01); *F21V 7/04* (2013.01); *F21V 7/22* (2013.01); *F21V 13/02* (2013.01); *F21V 3/00* (2013.01); *F21V 21/044* (2013.01); *F21Y 2115/10* (2016.08)

(58) Field of Classification Search
CPC ..... F21S 8/02–8/028
USPC ..... 362/364–366
See application file for complete search history.

(56) References Cited

U.S. PATENT DOCUMENTS

| | | | | |
|---|---|---|---|---|
| 8,770,779 | B2 | 7/2014 | Steadman et al. | |
| 2015/0241027 | A1* | 8/2015 | Zhang | F21S 8/026 362/300 |

* cited by examiner

*Primary Examiner* — Sean Gramling
(74) *Attorney, Agent, or Firm* — Kilpatrick Townsend & Stockton, LLP

(57) ABSTRACT

A recessed wall wash light fixture includes a light source and a hollow light guide. The hollow light guide has a reflective internal surface and forms upper and lower apertures along its upper and lower boundaries; the lower aperture is slanted upwardly in the forward direction. The hollow light guide includes a forward section and a rear section having respective wall surfaces. The forward and rear wall surfaces substantially meet one another at midlines that extend downwardly from the upper aperture to the lower aperture.

14 Claims, 6 Drawing Sheets

FIG. 1
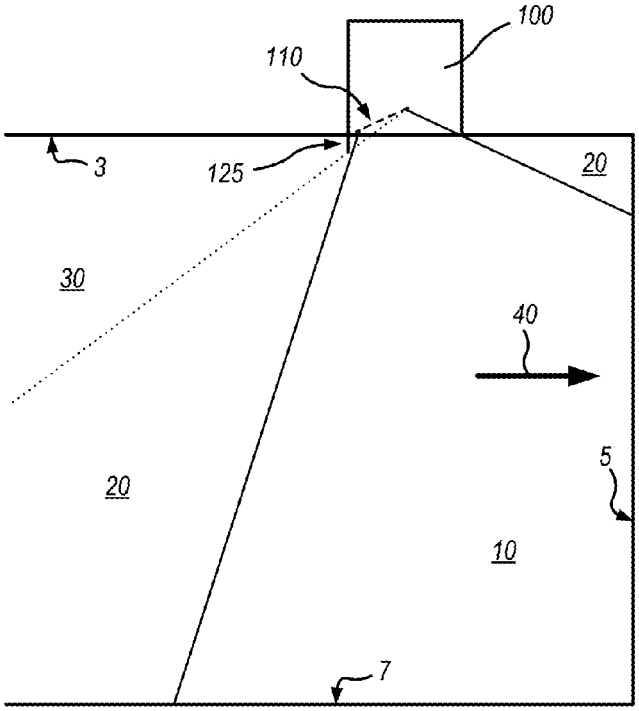
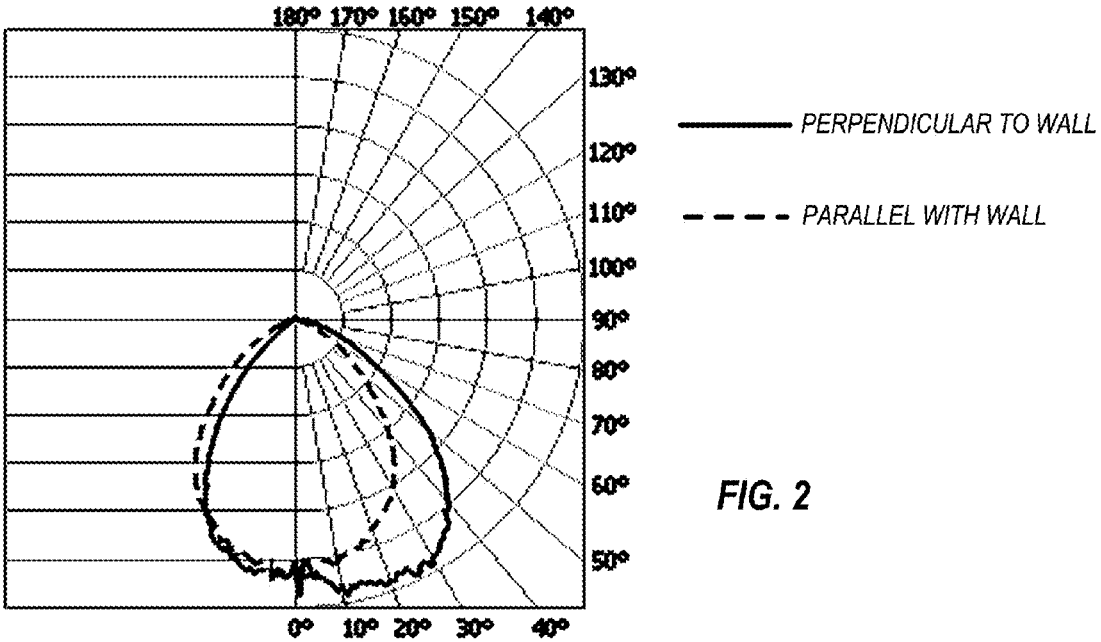
FIG. 2

RECESSED WALL WASH LIGHT FIXTURE WITH GLARE CONTROL

BACKGROUND

Recessed light fixtures are often utilized to illuminate spaces beneath a ceiling. So-called floodlights can be used in recessed light fixtures to provide illumination, but emit light over a wide range of angles. Light that is emitted into an illuminated space at a high angle forms undesirable glare. Shielding can be utilized to reduce glare, but generally introduces inefficiency in the form of some amount of light that strikes the shielding being converted to heat. Also, whether based on incandescent or compact fluorescent light sources (CFLs), floodlights and associated light fixtures that are based on Edison screw bases (e.g., A-series sockets) are somewhat large in size. Edison screw bases smaller than 12 mm diameter are typically only utilized for decorative or indicator purposes. Standard A-series sockets are a minimum of 26 mm in diameter, and the associated light bulbs are typically several times longer than the width of the base.

Light-emitting diodes (LEDs) are increasingly being deployed as illumination sources. They are not only as efficient as CFLs and highly reliable, but can provide large amounts of light from very small packages. Due to their high reliability, LEDs are often deployed as permanent parts of a light fixture, obviating the need for sockets and bases. Thus, optics and light fixtures to direct the emitted light can be smaller than would be needed for light sources based on Edison screw sockets and bases.

SUMMARY

In an embodiment, a recessed wall wash light fixture emits light downwardly and preferentially toward a forward direction into a space beneath a ceiling. The light fixture includes a light source that emits the light and a hollow light guide that reflects at least a portion of the light. The hollow light guide has a reflective internal surface and forms upper and lower apertures along respective upper and lower boundaries thereof. The lower aperture is slanted upwardly in the forward direction so as to have an upper, forward side and a lower, rearward side. The hollow light guide includes a forward section having a forward wall centerline that extends downwardly from a forward side of the upper aperture to the upper, forward side of the lower aperture, and forward wall surfaces that extend laterally from both sides of the forward wall centerline, and curve rearwardly. The hollow light guide also includes a rear section having a rear wall centerline that is concave with respect to the forward wall centerline, and curves downwardly from a rearward side of the upper aperture to the lower, rearward side of the lower aperture, and rear wall surfaces that extend laterally from both sides of the rear wall centerline, and curve forwardly. The forward and rear wall surfaces substantially meet one another at midlines that extend downwardly from the upper aperture to the lower aperture.

BRIEF DESCRIPTION OF THE DRAWINGS

The present disclosure is described in conjunction with the appended figures:

FIG. 1 schematically illustrates a recessed wall wash light fixture with glare control, illuminating a space, in accord with an embodiment.

FIG. 2 is a polar plot of photometric distributions, in two directions, of the light fixture of FIG. 1, in accord with an embodiment.

DETAILED DESCRIPTION

Figure 3A:
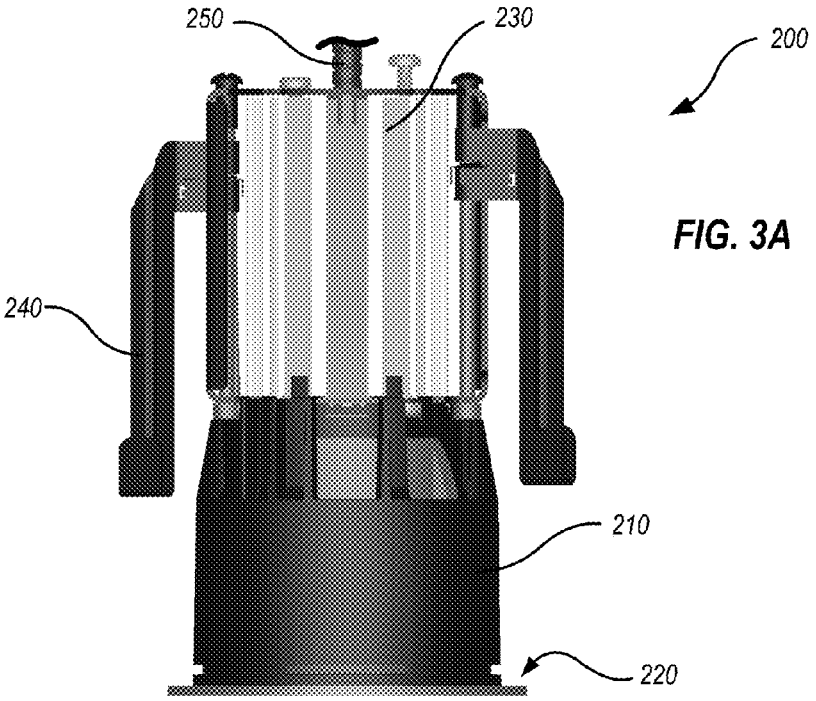
FIG. 3A is an external front elevation of certain parts of a recessed wall wash light fixture with glare control, in accord with an embodiment.

The present disclosure may be understood by reference to the following detailed description taken in conjunction with the drawings described below, wherein like reference numerals are used throughout the several drawings to refer to similar components. It is noted that, for purposes of illustrative clarity, certain elements in the drawings may not be drawn to scale. In instances where multiple instances of an item are shown, only some of the instances may be labeled, for clarity of illustration.

New and useful recessed wall wash light fixtures are disclosed herein. In embodiments, high efficiency reflectors are utilized to shape light from LEDs through a diffuser and toward a space to be illuminated. The shaped light is controlled so as to illuminate not only a floor beneath the light fixture, but also toward a wall. The LEDs provide high efficiency, which is maintained by using the high efficiency reflectors to provide high light output vs. power consumption. Certain embodiments herein include custom features to provide these attributes, while leveraging hardware that is common to other fixtures, and while providing a light fixture that fits a standard installation footprint.

FIG. 1 schematically illustrates a recessed wall wash light fixture 100 with glare control, illuminating a space. The representation of light fixture 100 is schematic only, and not representative of exact appearance or proportions. Light fixture 100 mounts within a ceiling 3, and projects light downwards toward a wall 5 and a floor 7 from a light emitting aperture 110. A forward direction 40 is defined as a lateral direction from light fixture 100 in the direction of wall 5. Parts of the space beneath light fixture 100 include a brightly lit region 10 and less brightly lit regions 20. Brightly lit region 10 may represent, for example a region that receives at least 50% of the maximum luminance that is emitted by light fixture 100 in any direction. A region 30 receives almost no light from light fixture 100, which may due in part to an optional glare shield 125, that shields region 30 from light emitting aperture 110 in certain embodiments.

FIG. 2 is a polar plot of photometric distributions of light fixture 100 in two directions: a distribution perpendicular to wall 5 shown as a solid line, and another distribution parallel with wall 5 shown as a broken line. It can be seen that the photometric distribution parallel with wall 5 is roughly symmetric, while the photometric distribution perpendicular to wall 5 is skewed, providing maximum relative luminance in a region that is roughly 10 to 30 degrees above nadir toward the wall, such that luminance is greater toward the wall than away from the wall. The scale of FIG. 2 is arbitrary in the radial direction; that is, the absolute values of luminance represented can be modified by providing brighter or dimmer LEDs in light fixture 100, and/or driving the LEDs with more or less current.

Figure 3B:
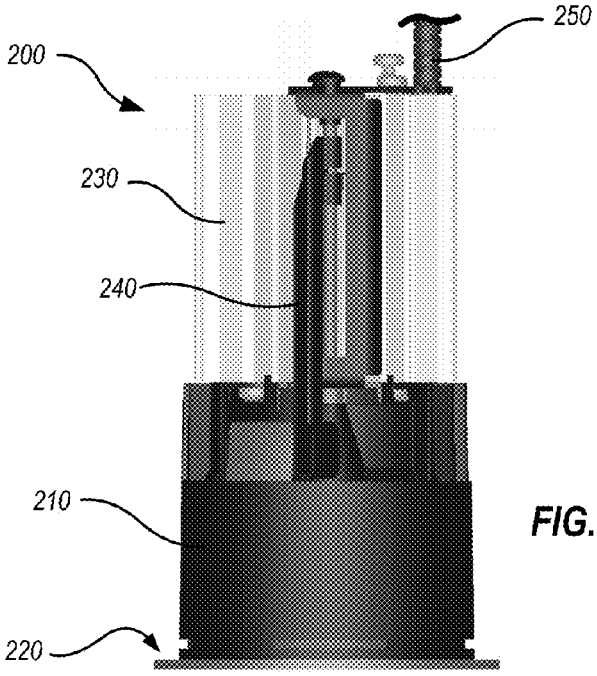
FIG. 3B is an external side elevation of the parts of a recessed wall wash light fixture with glare control shown in FIG. 3A.

FIG. 3A is an external front elevation of certain parts of a recessed wall wash light fixture 200 with glare control; FIG. 3B is an external side elevation of the same parts of light fixture 200. Light fixture 200 is an example of light fixture 100, FIG. 1. Each of FIGS. 3A, 3B show a housing 210 that includes a mounting flange 220 configured to couple with a ceiling (e.g., ceiling 3, FIG. 1). FIGS. 3A, 3B also show a heat sink 230 and spring arms 240 that can retract against housing 210 for insertion of fixture 200 into the ceiling. Also shown is a portion of a flexible cable 250 that runs to a power supply (not shown). For installation, a hole is formed in a ceiling, external power provided by a cable above the ceiling is connected with the power supply, and the power supply is pushed through the hole. Flexible cable 250 allows the power supply to lie to the side of the hole, providing clearance for light fixture 200 above the hole for installations where available space above the ceiling is limited. Light fixture 200 is then pushed through the hole with spring arms 240 retracted against housing 210 until spring arms 240 clear the ceiling, whereupon they return to their extended positions, so as to support light fixture 200 in place.

Figure 4A:
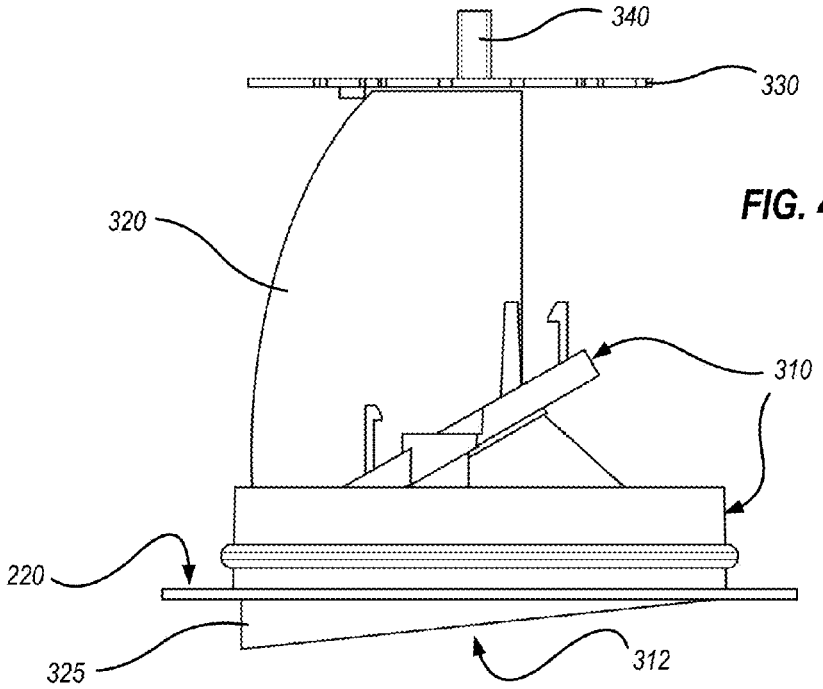
FIG. 4A is a side elevation of certain structural and optical features of the light fixture of FIGS. 3A and 3B, in accord with an embodiment.
Figure 4B:
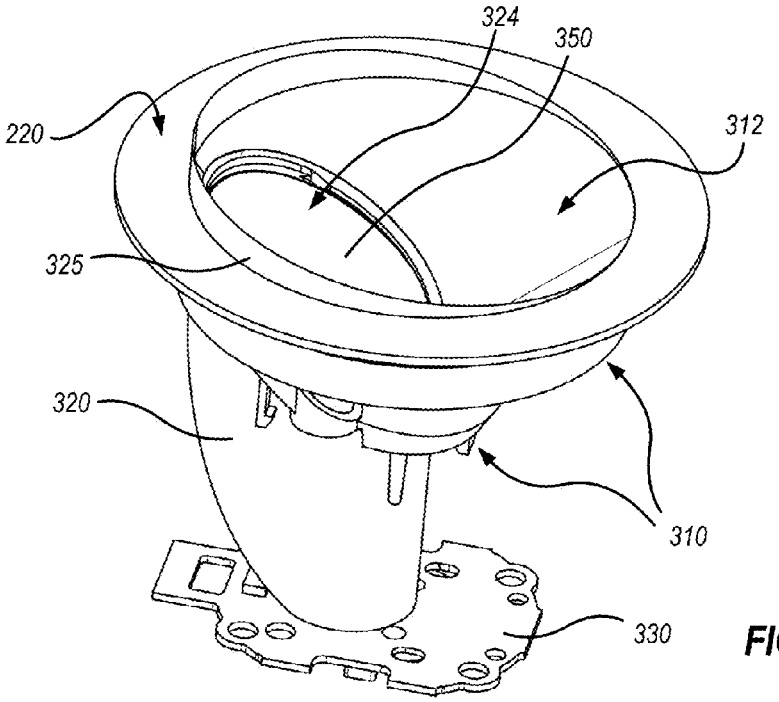
FIG. 4B is an isometric view of the features of the light fixture of FIGS. 3A and 3B, tilted for illustrative clarity, in accord with an embodiment.

FIG. 4A is a side elevation of certain structural and optical features of light fixture 200, FIGS. 3A and 3B; FIG. 4B is an isometric view of some of the same features of light fixture 200, provided in an underside view for illustrative clarity. FIGS. 4A and/or 4B show mounting flange 220 (seen in FIGS. 3A, 3B) coupled with support features 310, a hollow light guide 320, a printed circuit board (PCB) 330 with a connector 340 coupled thereto, and a diffuser 350. Support features 310 serve to provide mechanical support for light guide 320, PCB 330 and the like, and may take different forms from those shown. Hollow light guide 320 forms an upper aperture 322 (hidden in the views of FIGS. 4A and 4B; see FIGS. 5A-5D) and a lower aperture 324. Diffuser 350 is disposed within or across lower aperture 324 of light guide 320. A light source (typically LEDs, see FIG. 7) emits light through upper aperture 322. Light guide 320 has reflective internal surfaces that reflect light from the light source toward lower aperture 324, where it passes through diffuser 350 and exits the fixture via an output aperture 312, about which mounting flange 220 extends. Also shown in FIGS. 4A, 4B is an optional glare shield 325, an example of glare shield 125, FIG. 1.

Figure 5A:
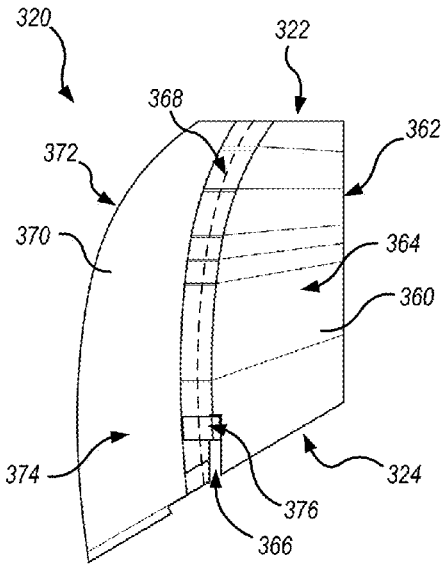
FIG. 5A is a side elevation of a hollow light guide, in accord with an embodiment.
Figure 5B:
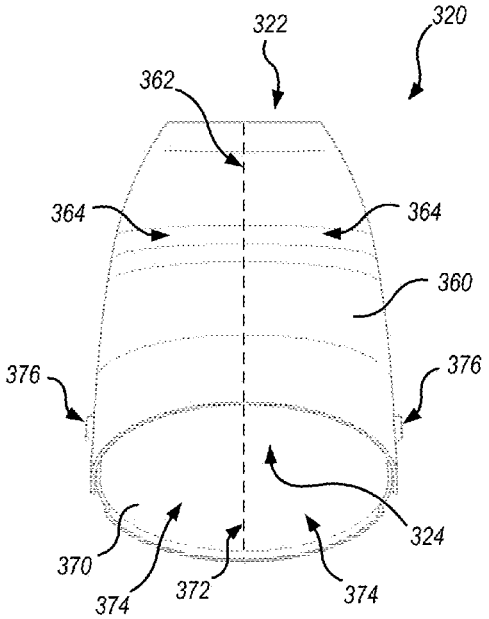
FIG. 5B is a front elevation of the hollow light guide of FIG. 5A, in accord with an embodiment.
Figure 5C:
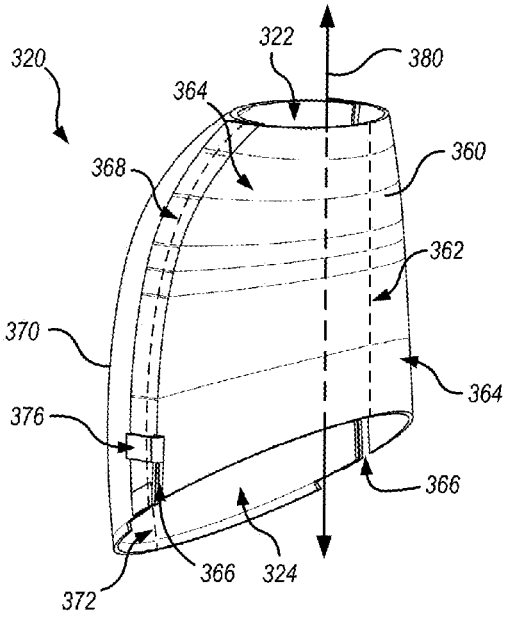
FIG. 5C is an isometric view of the hollow light guide of FIG. 5A, viewed at a slightly downward angle and substantially from a front side thereof, in accord with an embodiment.
Figure 5D:
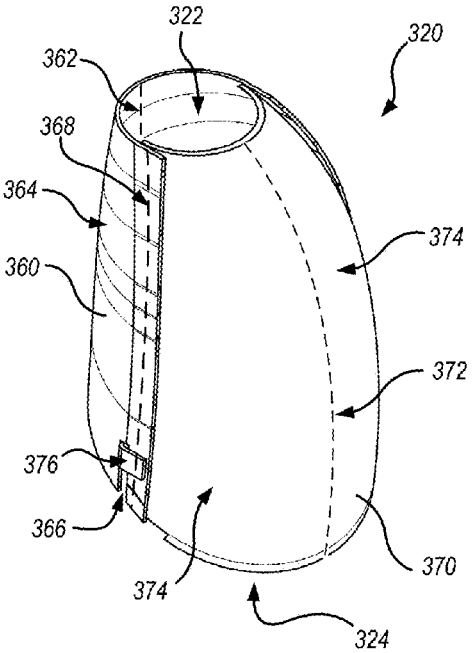
FIG. 5D is another isometric view of the hollow light guide of FIG. 5A, viewed at a substantially downward angle and substantially from a rear side thereof, in accord with an embodiment.

Several views of an exemplary light guide are provided to illustrate features thereof. FIG. 5A is a side elevation of hollow light guide 320. FIG. 5B is a front elevation of hollow light guide 320. FIG. 5C is an isometric view of hollow light guide 320, viewed at a slightly downward angle and substantially from a front side thereof. FIG. 5D is another isometric view of hollow light guide 320, viewed at a substantially downward angle and substantially from a rear side thereof. Each of FIGS. 5A-5D show hollow light guide having a forward section 360 (forward in the sense of forward direction 40, FIG. 1). Forward section 360 has a forward wall centerline 362 and forward wall surfaces 364 that extend laterally and curve rearwardly from both sides of forward wall centerline 362. Light guide 320 also has a rear section 370 that has a rear wall centerline 372 and rear wall surfaces 374 that extend laterally and curve forwardly from both sides of rear wall centerline 372. In the embodiment shown, forward wall centerline 362 is a straight vertical line, but this is not a requirement. Also, rear wall centerline 372 is concave with respect to forward wall centerline 362, but again this is not a requirement.

Hollow light guide 320 forms an upper aperture 322 along an upper boundary and a lower aperture 324 along a lower boundary thereof. In the embodiment shown, the upper boundary is approximately horizontal (e.g., defining a plane that is substantially parallel with a ceiling in which a light fixture that includes light guide 320 is mounted) while the lower aperture forms an angle with respect to the horizontal. In the embodiment shown, the angle formed by lower aperture 324 (and, in some embodiments, diffuser 350) is about 30 degrees; in other embodiments the angle formed by lower aperture 324 is within the range of 10 to 50 degrees with respect to horizontal. Forward section 360 and rear section 370 substantially meet one another along midlines 368 that extend downwardly along light guide 320 from upper aperture 322 to lower aperture 324, as shown. In this sense "substantially meet" includes embodiments wherein a small gap may exist between forward section 360 and rear section 370 (e.g., a gap of less than about 5% of the circumference of hollow light guide 320) or where forward section 360 and rear section 370 overlap one another. FIG. 5C also illustrates an emitter axis 380 that passes through a centroid of a light source (e.g., a center of a location of LEDs on an underside of PCB 330—see also FIG. 7).

Forward section 360 and rear section 370, together, form a light guide that is hollow and has highly reflective internal surfaces for directing substantially light emitted through upper aperture 322 toward diffuser 350. In certain embodiments, forward section 360 and rear section 370 are formed of aluminum or alloys thereof, with internal surfaces of forward section 360 and rear section 370 being highly polished and/or having highly reflective films formed thereon to enhance reflectivity. Some of these embodiments form forward section 360 and rear section 370 of coated anodized aluminum with greater than 94% reflectivity, available under the trade name of Alanod Miro. Still other embodiments form forward section 360 and rear section 370 of silver coated anodized aluminum with greater than 97% reflectivity, available under the trade name of Alanod Miro-Silver.

Forward section 360 and rear section 370 typically join in some way, although joining is not required. In the examples shown in FIGS. 5A-5D a portion of rear section 370 forms a tab 376 that passes through and folds back around a slot 366 defined by forward section 360. However, the sections that form tabs and slots may be reversed in other embodiments, or other ways to join forward section 360 with rear section 370 may be employed. Still other embodiments do not join forward section 360 with rear section 370 but rather assemble them with structural support that holds them in proximity with one another.

Fabrication of forward section 360 and rear section 370 from high reflectivity materials such as Alanod Miro or Alanod Miro-Silver may be challenging due to the presence of the highly reflective layers thereof. Reflectivity of the layers can be compromised or destroyed by scratching or crushing when sheets thereof are bent, especially when the bending is in more than one plane. Therefore, in embodiments, forward section 360 is formed from a sheet of reflective material by only bending it in one direction (an azimuthal direction about light emitter axis 380, see FIG. 5C and FIG. 7). Fabrication of rear section 370 is challenging in that as designed it curves significantly in two directions. However, an excellent approximation of the designed shaped of rear section 370 (e.g., as shown in FIGS. 4A, 4B, 5A, 5B, 5C and 5D) can be produced by forming a sheet that defines tabs separated by substantially triangular slots. Then, the sheet is compressed in a mold of the desired final shape, such that the tabs substantially meet in the final shape of rear section 370.

Figure 6:
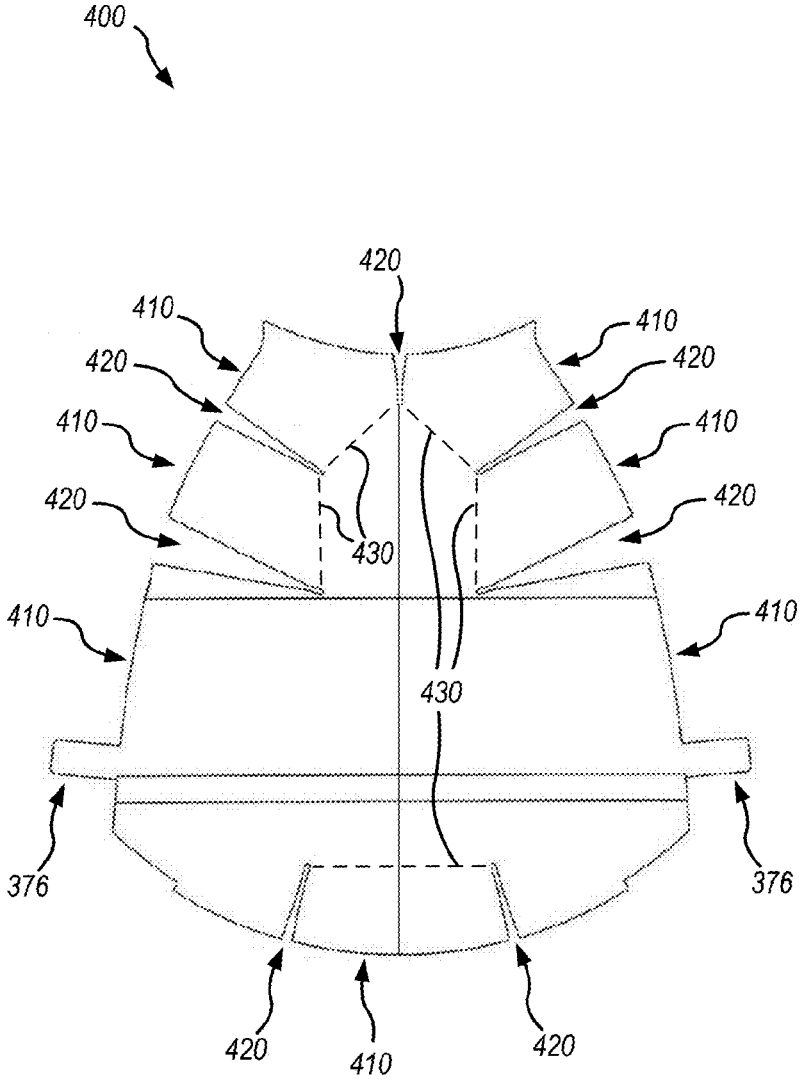
FIG. 6 schematically illustrates a sheet of material having tabs with slots therebetween, to facilitate forming the sheet into the rear section of the hollow light guide of FIG. 5A, in accord with an embodiment.

FIG. 6 schematically illustrates a sheet 400 of reflective material having tabs 410 with slots 420 therebetween, to facilitate forming sheet 400 into rear section 370. In this embodiment, tabs 376 are also formed for eventual assembly of rear section 370 with forward section 360 (see FIGS. 5A-5D). When compressed to form rear section 370, tabs 410 and slots 420 may encourage local bending to prefer certain locations, such as the locations marked in FIG. 6A with broken lines 430, such that rear section 370 does not form perfectly smooth curves as designed. However, preferential bending at locations such as lines 430 during fabrication has been found not to have a significant impact on optical performance of the final product, much like the manner in which forward section 360 and rear section 370 are joined (or not) has little impact. Thus it should be understood that aspects such as the forward and rear sections substantially meeting one another, the shape of slots 420 being substantially triangular, and the like are sufficient, and do not distinguish embodiments herein from one another; similarly, reflectors or sections thereof that curve along a generally concave outline but irregularly (such as at broken lines 430) are described herein as "concave" although some embodiments do not form a concave curve, but more of an approximately concave form that may include straight line segments.

Figure 7:
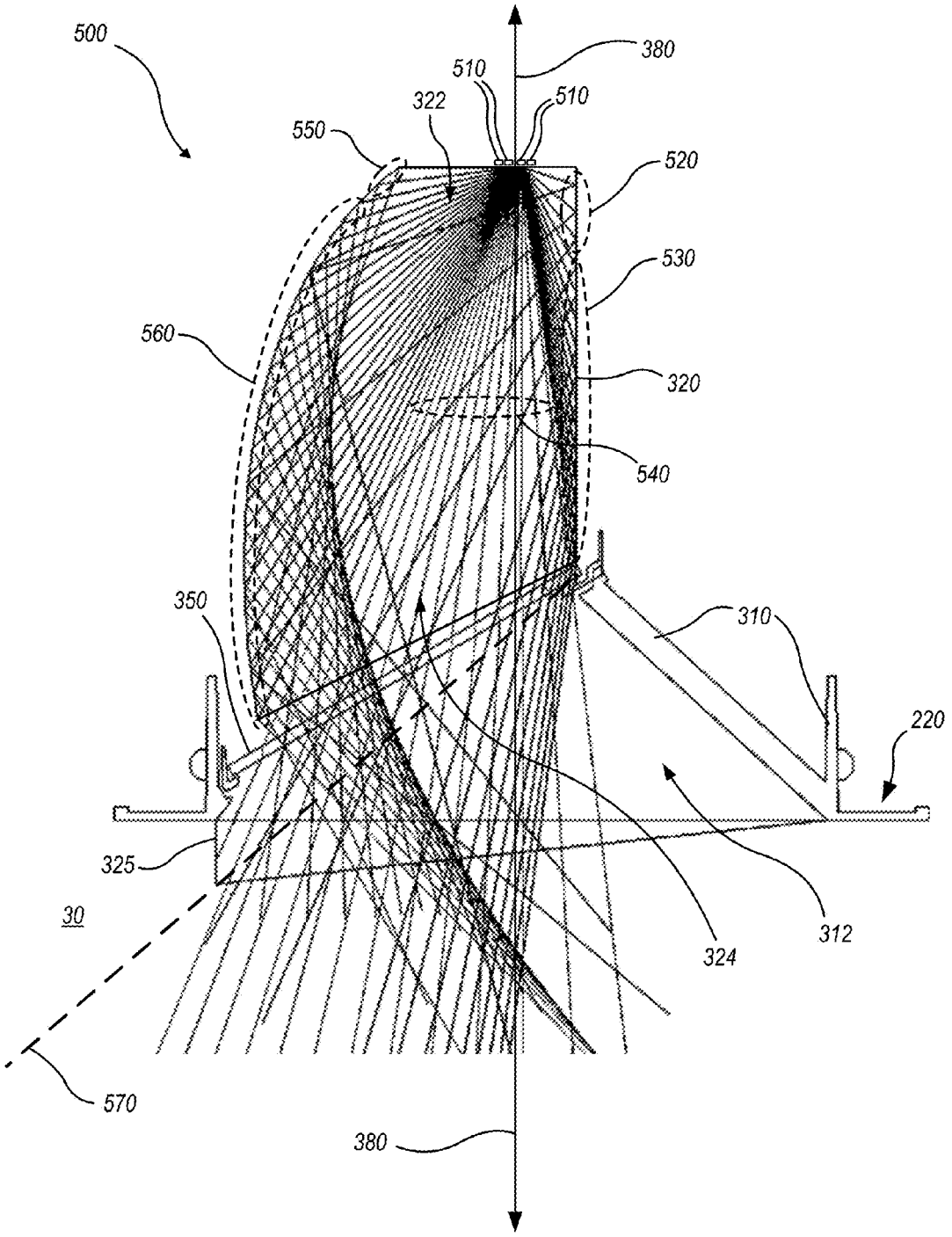
FIG. 7 is a ray trace diagram illustrating optical properties of a recessed wall wash light fixture with glare control, in accord with an embodiment.

FIG. 7 is a ray trace diagram 500 illustrating certain optical features of a recessed wall wash light fixture with glare control. Ray trace diagram 500 illustrates a cross-sectional plane through the features shown in FIG. 4A, although diagram 500 does not show PCB 330, connector 340 and some of support structure 310. Physical features illustrated in diagram 500 include hollow light guide 320, some of support structure 310 including mounting flange 220, diffuser 350, glare shield 325, and LEDs 510, as shown (in an actual fixture, LEDs 510 are mounted on an underside of PCB 330, FIG. 4A). Hollow light guide 320 defines upper aperture 322 and lower aperture 324, and support structure 310 defines output aperture 312, as shown. FIG. 7 illustrates how an advantageous light distribution is obtained from these features, as follows.

Light from LEDs 510 is generally emitted downwardly through upper aperture 322, but at a variety of angles. These rays are shown in FIG. 7 as originating from a single point only for clarity of illustration, light coming from points near to the one illustrated making no difference in the concepts now discussed. In clockwise order, a first portion 520 of the light reflects from light guide 320 (specifically, from forward section 360; see FIGS. 5A-5D), re-reflects within light guide 320 (from rear section 370) and passes forwardly through lower aperture 324. A second portion 530 of the light reflects from light guide 320 (from forward section 360) and passes rearwardly through lower aperture 324. A third portion 540 emits directly from LEDs 510 through lower aperture 324. A fourth portion 550 reflects twice from from rear section 370 of light guide 320, first near upper aperture 322 and then closer to lower aperture 324, exiting lower aperture 324 forwardly. A fifth portion 560 reflects once from light guide 320 (from rear section 370) and exits lower aperture 324 forwardly. Portions 520, 530, 550 and 560 are identified in FIG. 7 by the surface portions of light guide 320 at which they first reflect, while portion 540 is identified near the center of light guide 320; portion 540 does not include the few rays of portions 520 and 530 that pass through the location noted in FIG. 7. Certain stray rays will strike glare shield 325 and will be blocked by it, as shown.

Although ray trace diagram 500 shows light rays proceeding in straight lines, diffuser 350 will act to scatter some of the light reaching it. However, diffuser 350 is advantageously not highly scattering, but has a field angle with respect to incoming rays. That is, light that strikes diffuser 350 is not equally scattered in all directions, but primarily continues along its previous direction, forming a cone aligned with the original direction. About half the light passing through diffuser 350 at a given point will diverge into a cone that is aligned with the original direction and forms an angle (the field angle) originating at the point. This causes the photometric distribution of the light fixture to "smear," obscuring bright and dark spots due to individual features yet retaining the overall directionality of light provided by light guide 320.

In embodiments, diffusers 350 have field angles of 10 degrees to 50 degrees, and a particular embodiment uses a diffuser having a field angle of 30 degrees.

Because each point of output aperture 312 (or diffuser 350) can be a source of at least some light, a glare-free region 30 (also see FIG. 1) can be provided by extending glare shield 325 from at least a rearward portion of a periphery of output aperture 312. Glare-free region 30 can be defined as a region in which glare shield 325 blocks light passing through any part of diffuser 350 from reaching the region. Line 570 shows the lower extent of glare-free region 30 in FIG. 7. In the plane illustrated (a vertical plane passing from front to rear through a center of light guide 320), a lower bound of glare-free region 30 is shown as line 570. Line 570 forms an angle of slightly over 40 degrees with respect to horizontal. In embodiments, glare shield 325 extends further downward to create a larger glare-free region (that is, line 570 forms a greater angle from horizontal). Also, in embodiments, glare shield 325 can extend vertically downward from the portion of the periphery of the output aperture, while in other embodiments, glare shield 325 can extend downwardly at angles other than vertical.

The foregoing is provided for purposes of illustrating, explaining, and describing various embodiments. Having described these embodiments, it will be recognized by those of skill in the art that various modifications, alternative constructions, and equivalents may be used without departing from the spirit of what is disclosed. Different arrangements of the components depicted in the drawings or described above, as well as additional components and steps not shown or described, are possible. Certain features and subcombinations of features disclosed herein are useful and may be employed without reference to other features and subcombinations. Additionally, a number of well-known processes and elements have not been described in order to avoid unnecessarily obscuring the embodiments. Embodiments have been described for illustrative and not restrictive purposes, and alternative embodiments will become apparent to readers of this patent. Accordingly, embodiments are not limited to those described above or depicted in the drawings, and various modifications can be made without departing from the scope of the claims below. Embodiments covered by this patent are defined by the claims below, and not by the brief summary and the detailed description.

What is claimed is:

1. A recessed wall wash light fixture that emits light downwardly and preferentially toward a forward direction into a space beneath a ceiling, the light fixture comprising:

a light source that emits the light;

a hollow light guide that reflects at least a portion of the light, wherein the hollow light guide substantially encloses a space between:

an upper aperture, wherein the light source is configured and oriented so as to emit the light through the upper aperture, and a lower aperture that is slanted upwardly in the forward direction so as to have an upper, forward side and a lower, rearward side;

the hollow light guide consisting essentially of:

a first reflective sheet that is curved to form a forward section having:

a forward wall centerline that extends downwardly from a forward side of the upper aperture to the upper, forward side of the lower aperture, and forward wall surfaces that extend laterally from both sides of the forward wall centerline, and curve rearwardly; and a second reflective sheet that is curved to form a rear section having:

a rear wall centerline that is concave with respect to the forward wall centerline, and curves downwardly from a rearward side of the upper aperture to the lower, rearward side of the lower aperture, and rear wall surfaces that extend laterally from both sides of the rear wall centerline, and curve forwardly;

such that the forward and rear wall surfaces substantially meet one another at midlines that extend downwardly from the upper aperture to the lower aperture.

2. The recessed wall wash light fixture of claim 1, further comprising a diffuser disposed across the lower aperture such that substantially all of the light passes through the diffuser.

3. The recessed wall wash light fixture of claim 2, wherein the diffuser has a field angle within the range of 10 to 50 degrees.

4. The recessed wall wash light fixture of claim 2, further comprising a housing that includes a mounting flange that defines an output aperture for the light fixture, wherein:

the housing is configured to couple with the ceiling when an upper surface of the mounting flange abuts a lower surface of the ceiling;

the output aperture is an opening within a lowermost planar surface of the mounting flange;

the housing supports the diffuser, the hollow light guide and the light source such that, when the mounting flange couples with the ceiling:

the upper aperture of the hollow light guide defines a plane that is substantially parallel with the upper surface of the mounting flange; and the lower aperture of the hollow light guide is disposed above the output aperture, and forms an angle of 10 to 50 degrees with respect to the upper surface of the mounting flange.

5. The recessed wall wash light fixture of claim 4, the housing further comprising a glare shield extending downwardly from at least a portion of a periphery of the output aperture, wherein the glare shield is configured to block light passing through any part of the diffuser from a glare-free region of the space.

6. The recessed wall wash light fixture of claim 5, wherein:

the glare shield extends vertically downward from the portion of the periphery of the output aperture;

the glare shield extends furthest downwardly from a rear side of the output aperture; and in a plane passing from front to rear through a center of the hollow light guide, a lower bound of the glare-free region is defined at an angle of greater than 40 degrees from horizontal.

7. The recessed wall wash light fixture of claim 1, wherein the light source comprises one or more light-emitting diodes (LEDs) disposed on a circuit board so as to emit the light downwardly through the upper aperture of the hollow light guide, the light source defining a light emitter axis that is perpendicular to the circuit board and passes through a centroid of the LEDs.

8. The recessed wall wash light fixture of claim 7, wherein:

the forward wall centerline is a straight line from the forward side of the upper aperture to the upper, forward side of the lower aperture;

the forward section curves in an azimuthal direction relative to the light emitter axis; and the rear section curves in both azimuthal and axial directions relative to the light emitter axis.

9. The recessed wall wash light fixture of claim 1, wherein:

the forward section:

reflects a first portion of the light from the light source such that it passes rearwardly and directly through the lower aperture of the hollow light guide, and reflects a second portion of the light from the light source and directs the second portion rearwardly toward the rear section of the hollow light guide;

and the rear section:

re-reflects the second portion of the light from the light source such that it passes forwardly through the lower aperture of the hollow light guide, reflects a third portion of the light from the light source such that it passes forwardly through the lower aperture of the hollow light guide, reflects a fourth portion of the light from the light source downwardly, and re-reflects the fourth portion of the light such that it passes forwardly through the lower aperture of the hollow light guide.

10. The recessed wall wash light fixture of claim 1, wherein the forward and rear sections are discrete physical sections that are joined to form the hollow light guide.

11. The recessed wall wash light fixture of claim 1, wherein at least one of the forward section and the rear section is formed of an metal that is coated at least on an internally facing surface thereof with one or more reflection-enhancing films, such that a reflectance of the internally facing surface exceeds 94%.

12. The recessed wall wash light fixture of claim 11, wherein at least one of the reflection-enhancing films comprises silver, and the reflectance of the internally facing surface exceeds 97%.

13. The recessed wall wash light fixture of claim 11, wherein the rear section is formed of a planar sheet of the metal having the one or more reflection-enhancing films, wherein:

the planar sheet comprises tabs having sides that are separated by substantially triangular slots when the sheet is unbent, and the sides of the tabs substantially meet when the sheet is bent to form the rear section.

14. The recessed wall wash light fixture of claim 7, wherein the circuit board is disposed proximate to the upper aperture, and wherein the light enters through the upper aperture without passing through optics.

* * * * *